United States Patent [19]

Stidston et al.

[11] Patent Number: 4,995,318

[45] Date of Patent: Feb. 26, 1991

[54] INTERNALLY RIFLED PROJECTILE

[76] Inventors: Harvey Stidston; Merritte W. Stidston, both of 1456 Wrenwood, Clovis, Calif. 93612

[21] Appl. No.: 337,645

[22] Filed: Apr. 13, 1989

[51] Int. Cl.[5] ..... F42B 10/34

[52] U.S. Cl. ..... 102/503; 102/501; 244/3.23

[58] Field of Search ..... 102/501, 503, 703; 244/3.23

[56] References Cited

U.S. PATENT DOCUMENTS

| | | | |
|---|---|---|---|
| 922,638 | 5/1909 | Spencer | 244/3.23 |
| 2,559,955 | 7/1951 | Hartwell | 244/3.23 |
| 2,918,006 | 12/1959 | Von Zborowski | 102/503 |
| 2,989,922 | 6/1961 | Greenwood et al. | 244/3.23 |
| 3,880,083 | 4/1975 | Wasserman et al. | 102/703 |
| 4,016,817 | 4/1977 | Arciniega Blanco | 244/3.23 |
| 4,384,528 | 5/1983 | Moore et al. | 102/503 |
| 4,627,357 | 12/1986 | Gobis | 102/503 |
| 4,805,535 | 2/1989 | Marcon | 102/503 |

FOREIGN PATENT DOCUMENTS

| | | | |
|---|---|---|---|
| 551468 | 11/1956 | Italy | 244/3.23 |

*Primary Examiner*—Harold J. Tudor
*Attorney, Agent, or Firm*—Mark D. Miller

[57] ABSTRACT

A one piece interally rifled projectile having a cylindrical annular wing surrounding an teardrop-shaped axial core connected to such wing by three helical, canted, tapered vanes. The projectile has a smooth exterior surface, and may be equipped with an explosive charge. As the projectile passes through the air, it rotates so as to provide a stable long-range trajectory.

7 Claims, 2 Drawing Sheets

INTERNALLY RIFLED PROJECTILE

BACKGROUND OF THE INVENTION

1. Field of the Invention

The present invention relates generally to ammunition and, more particularly, to tubular projectiles having both annular wings and interior canted vanes.

2. Description of Related Art

In the field of ammunition projectiles, there exists a continuing need to provide improved projectiles with longer range, better accuracy and reduced aerodynamic drag. Over the years, numerous projectile designs have been introduced that address one or more of these aspects.

A common approach to reducing drag is to provide a projectile that is hollow or tubular in shape. Recent United States patents including Flatau U.S. Pat. No. 4,301,736, Matthui U.S. Pat. No. 4,413,565, and Flatau U.S. Pat. No. 4,579,059, each describe tubular projectiles. The advantage provided by the tubular shape is less drag, longer range and increased impact force. Unfortunately, the tubular design is not aerodynamically stable, and despite the disclosures of Flatau U.S. Pat. No.4,579,059, tubular projectiles cannot carry as much explosive material as a solid projectile having the same diameter.

Other projectiles such as that disclosed in Romer, U.S. Pat. No. 4,153,223, provide solid high speed projectiles having wing-like air control passages which provide a stabilizing characteristic for the projectile. Unfortunately, these wings also impart a considerable degree of drag on the projectile thus limiting its range.

The concept of a rotating or spinning projectile is disclosed in Ballmann, U.S. Pat. No. 4,296,893 and Gobis, U.S. Pat. No. 4,627,357. Ballmann provides spin imparting passages in rings detachably connected to a projectile while it rests in the barrel of a gun or cannon, which rings fall away from the projectile after it leaves the barrel of the gun. The rings of Ballmann contain passageways which utilize the force of the propellant gas to impart a spin to the projectile as it leaves the barrel of the gun. Alternatively, Ballmann describes a central passageway within the projectile itself which channels the propellant gases up through the interior of the projectile in such a way as to impart spin as the projectile passes through the barrel of the gun.

It is advantageous to provide projectiles with spin so as to bring about stabilization of the projectile in flight. However, the spin imparted to the Ballmann projectile ceases once it leaves the barrel of the gun. Gobis, 4,627,357 addresses this problem by providing a helical fin and exterior fins to its tubular body to impart spin to the projectile during flight. However, the Gobis fins impart additional drag to the projectile in causing the spin, and therefore reduces its range. Furthermore, Gobis provides no convenient means for carrying an explosive charge.

The concept of an annular wing is well known in the art (e.g. Zborowski U.S. Pat. No. 2,918,006). An annular wing has been used in combination with canted vanes to provide a spinning annular wing for purposes of lift and stability, Herrmann U.S. Pat. Nos. 3,065,932 and 3,135,484. The spinning of an annular wing around a central axis stabilizes the air frame by the gyroscopic effect. However, the Zborowski design lacks any canted vanes, and the Herrmann design refers only to self propelled aircraft and not a projectiles at all. (Chiorky U.S. Pat. No. 2,691,495)

SUMMARY OF THE INVENTION

The present invention is a one piece internally-rifled projectile having an axial core connected to an outer cylinder by no less than three arms. The exterior cylindrical surface of the projectile is smooth and untapered. The axial core may be solid or may be hollowed out to contain a substantial explosive charge. The internal surface of the cylinder provides an annular wing through tapering of the interior circumferential wall from fore to aft. The arms connecting the central core to the cylinder are comprised of helical canted vanes which run the length of the cylinder. In addition to being helical and canted, these vanes are also tapered from fore to aft in much the same way as the annular wing. As a result of months of research and several improved prototypes, the applicant has discovered that the unique internal chambers created by the annular wing and the helical, canted, tapered internal vanes in combination with a smooth untapered exterior cylindrical body provide for a highly efficient means of imparting spin or rifling to the projectile during flight with a minimum of drag. The result is a highly stable long-range projectile capable of carrying an explosive charge.

After the projectile of the present invention has left the barrel of the gun from which it is fired, the openings between the vanes accept air which passes therethrough. Without such openings, air coming in contact with the front of the projectile would be forced to the side at an open (acute) angle, slowing the projectile (drag) thus limiting its range. The vanes between these openings are helical, canted and tapered. The helical, canted nature of the vanes imparts spin. The added feature of tapering the vanes allows them to produce the familiar "lift" associated with the Bernoulli principle. This reduces the air pressure within the openings causing air to be drawn in from the front as the projectile spins and passes through the air.

The annular wing allows the projectile to maintain a flat trajectory, and the helical vanes produce a spin which further stabilizes the trajectory through the gyroscopic effect. The unique tapering of the helical vanes further increases stability by causing additional spin and further reducing drag on the projectile. No gun barrel rifling is required to impart spin to the projectile, nor must the projectile be self-propelled.

Through trial and error, it has been determined that the proper distribution of the mass of the projectile plays a critical role in providing the most efficient rotation and the longest range. The present design for the projectile was selected after pains taking effort wherein it was determined that if the projectile were viewed from the side and divided into four parts, that fifty-one percent (51%) of the mass must be in the front two-fourths, and forty-nine percent (49%) of the mass in the rear two-fourths. Additionally, the applicant has determined that fifty-three percent (53%) of the mass must be in the second and third quarters. As a result, the heaviest quarter of the projectile is the second, followed next in order by the third, and the first quarter, with the last quarter being the lightest. This weight distribution is achieved by providing a buldging axial core near the front of the projectile, and tapering the annular wing and vanes toward the rear of the projectile. Thus, the weight distribution works in conjunction with the helical, canted, tapered design to produce a long-range, highly stable projectile.

Upon impact, the annular wings and helical, canted, tapered vanes are sloughed off first, allowing the axial core to achieve maximum penetration and, if so equipped, maximum explosive force.

It is therefore an object of the present invention to provide a highly accurate, long-range projectile capable of delivering a considerable explosive at a substantial impact. It is a further object of the present invention to provide an efficient single-piece artillery round capable of maintaining a high velocity over a long range with great accuracy.

DESCRIPTION OF THE PREFERRED EMBODIMENTS

No attempt is made to show structural details of the invention in more detail than is necessary for a fundamental understanding of the invention, the description taken with the drawings making apparent to those skilled in the art how the several forms of the invention may be embodied in practice.

Figure 1:
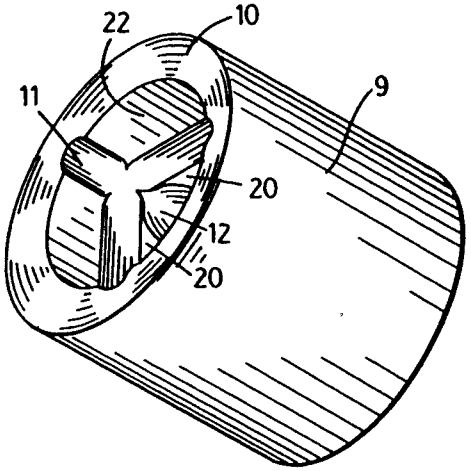
FIG. 1 is a perspective view of one embodiment of the projectile of the type described herein.
Figure 2:
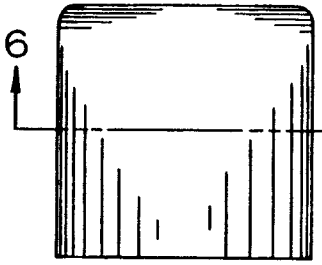
FIG. 2 is a side view of the projectile of the type described herein.

Referring to the drawings wherein like reference characters designate like or corresponding parts throughout the several views, and referring particularly to FIG. 1, it is seen that the invention comprises a cylindrical one-piece projectile 9 having a smooth, untapered exterior surface. The cylindrical body 9 of the projectile is composed of an annular wing 10 having an untapered internal surface area 22 near the front connected to a tapered surface area 21 at the rear (aft).

Figure 3:
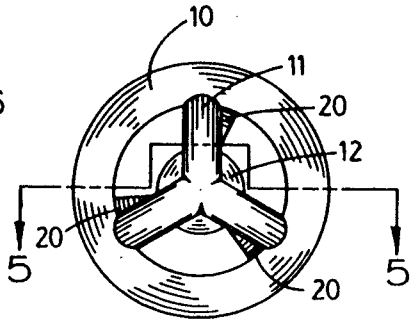
FIG. 3 is a top view of the projectile described herein.
Figure 4:
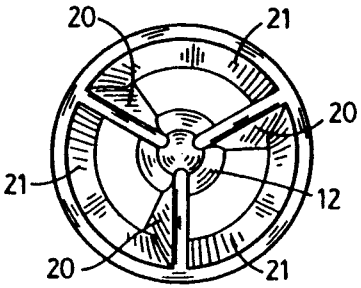
FIG. 4 is a bottom view of the projectile described herein.
Figure 5:
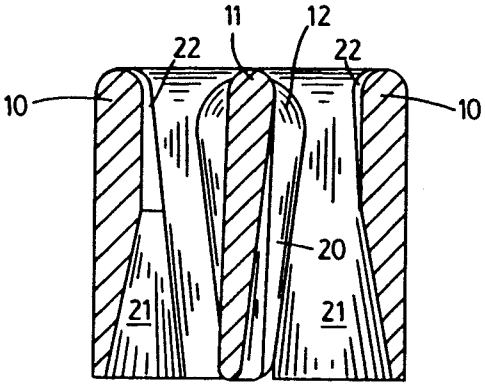
FIG. 5 is a sectional view taken through line 5—5 of FIG. 3 showing the tapering of the annular wing, as well as the tapering of one of the helical, canted vanes.
Figure 6:
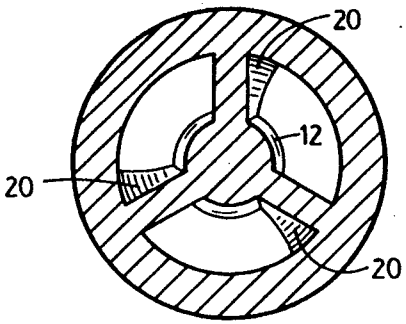
FIG. 6 is a sectional view taken along line 6—6 of FIG. 2.
Figure 6A:
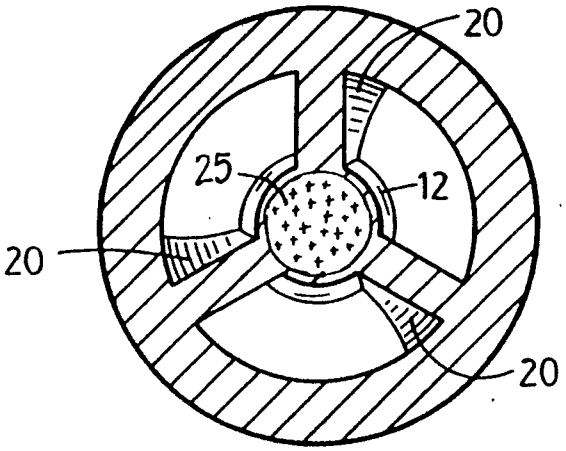
FIG. 6A is a sectional view taken along line 6—6 of FIG. 2 showing an alternative embodiment with a cavity filled with explosive material.

As seen in FIGS. 3, 4 and 5, the projectile includes a teardrop-shaped axial core 12 connected to the cylindrical body 9 by means of no less than three (3) arms 11 having helical, canted vanes 20 thereon. The front portion 10 of the annular wing is untapered. The teardrop-shaped axial core 12 may be hollow in order to hold an explosive material 25 as shown in FIG. 6A.

In operation, the internally rifled projectile is fired from a gun barrel and spins as it flies through the air. Air enters the passage ways defined by the arms 11 and the front portion of the annular wing 10. As the air passes through the projectile, it flows across the helical, canted vanes 20 imparting spin to the projectile. Tapering of the annular wings and the helical, canted vanes reduces the pressure of the air passing through the projectile, reducing drag and causing additional air to be sucked into the front of the projectile. This phenomenon is made possible because of the combined helical, canted and tapered vanes as well as the unique mass distribution of the projectile. As a result, the projectile spins efficiently for a much longer range than other projectiles not having these features.

We claim:

1. An internally rifled projectile comprising a cylindrical annular wing surrounding a teardrop-shaped axial core connected to such annular wing by three helical, canted vanes which run the length of the wing but which core and vanes do not extend beyond the front outer cylindrical surface of the annular wing, such vanes being tapered from front to rear.

2. The projectile described in claim 1 wherein 51% of the mass of the projectile is located forward of the longitudinal center of the projectile, and 49% of the mass of said projectile is located aft of the longitudinal center of the projectile.

3. The projectile described in claim 2 wherein the mass is distributed over four longitudinal segments of equal length from fore to aft, so that the heaviest segment of said projectile is the second segment from the front, followed in order of heaviness by the third segment, first segment, and fourth segment.

4. The projectile described in claim 3 wherein said annular wing has a smooth exterior cylindrical surface.

5. The projectile described in claim 4 wherein the teardrop-shaped axial core is hollowed out in order to hold an explosive material.

6. The projectile described in claim 1 wherein said annular wing has a smooth exterior cylindrical surface.

7. The projectile described in claim 6 wherein the teardrop-shaped axial core is hollowed out in order to hold an explosive material.

* * * * *